United States Patent [19]

Smith

[11] 4,151,216

[45] Apr. 24, 1979

[54] CATALYTIC CRACKING OF BY-PRODUCT POLYPROPYLENE

[75] Inventor: Vernon C. Smith, Wilmington, Del.

[73] Assignee: Hercules Incorporated, Wilmington, Del.

[21] Appl. No.: 845,171

[22] Filed: Oct. 25, 1977

[51] Int. Cl.[2] ..... C07C 3/26

[52] U.S. Cl. ..... 260/683 PD

[58] Field of Search ..... 260/683 PD

[56] References Cited

U.S. PATENT DOCUMENTS

| | | | |
|---|---|---|---|
| 2,196,363 | 4/1940 | Robertson | 260/683 PD |
| 3,750,600 | 8/1973 | Oshol et al. | 260/683 PD |
| 3,832,151 | 8/1974 | Kitaoka et al. | 260/683 PD |
| 3,845,157 | 10/1974 | Woo | 260/683 PD |
| 3,985,820 | 10/1976 | Albright et al. | 260/683 PD |

*Primary Examiner*—C. Davis

*Attorney, Agent, or Firm*—John W. Whitson

[57] ABSTRACT

By-product polypropylene may be converted by catalytic cracking into a fuel oil product having the viscosity necessary to permit it to be pumped and stored at the temperatures normally used for fuel oils. The cracking process is carried out at a temperature of, for example, 450° C. in a tubular reactor using a silica-on-alumina catalyst.

2 Claims, No Drawings

CATALYTIC CRACKING OF BY-PRODUCT POLYPROPYLENE

This invention relates to a process for producing fuel oil from the by-product polypropylene recovered during the manufacture of isotactic polypropylene. More particularly, the invention relates to the cracking of the by-product polypropylene in the presence of a silica-on-alumina catalyst.

By-product polypropylene recovered from the preparation of isotactic polypropylene is a partially crystalline material which solidifies on storage at room temperatures. This by-product material is high in molecular weight, sufficiently so that the viscosity of the material is too great for it to be stored, pumped and fed to conventional burner systems at the temperatures normally used for fuel oils. The usual temperature for storing and pumping No. 6 fuel oil, for example, is in the vicinity of 50° C.

Processes for cracking by-product polypropylene to form various types of products already are known in the art. For example, in U.S. Pat. No. 3,985,820 to Albright et al, there is disclosed a process wherein polypropylene in finely-divided form is contacted in a reactor with a cracking gas at a temperature such that the outlet temperature of the reactor is in the range of 800° to 1050° C. The product of this process is composed primarily of normally gaseous hydrocarbons.

On the other hand, in U.S. Pat. No. 3,832,151 to Kitaoka et al, the process is one of decomposing by-product polypropylene at a temperature in the range of 400° to 450° C., whereby there is produced a recovered product composed primarily of an oil fraction, but also containing an appreciable amount of a normally gaseous hydrocarbon fraction. A similar process is disclosed in U.S. Pat. No. 3,956,414 and U.S. Pat. No. 3,998,595, both to Oshima.

The aforementioned processes may generally be characterized as producing substantial quantitities of gaseous and volatile liquid products. However, if the production of a fuel oil is desired, for example, one having properties similar to No. 6 fuel oil, the formation of gaseous and volatile liquid products needs to be minimized, since these products not only reduce the yield of the oil, but also provide the oil with an undesirably low flash point.

Now in accordance with this invention, a process has been found whereby by-product polypropylene may be converted in high yield to a fuel oil product which can be handled and used on essentially the same basis as No. 6 fuel oil. In this process the by-product polypropylene is catalytically cracked by bringing it into contact with the silica-on-alumina catalyst at a temperature in the range of from about 425° to about 475° C., thereby producing as the principal product a fuel oil which may be stored and pumped at temperatures of, for example, 50° C. By proper control of reaction conditions, this product can be obtained with little attendant formation of gaseous and volatile liquid products.

In carrying out the process of this invention, the by-product polypropylene is melted by heating it to a temperature of, for example, about 150° to 350° C., and the molten material subsequently may be passed through a heat exchanger to elevate the temperature of the material to a point where it closely approximates the temperature used in the cracking step of the process. The molten material then is passed through a tubular reactor containing a silica-on-alumina catalyst, the temperature of the reactor being in the range of from about 425° to 475° C. Space times in the range of from about five to about 15 grams of the catalyst per gram of the polymer fed to the reactor per minute are used. The product exiting from the reactor then is cooled, usually in two stages, to effect separation of the liquid and gas phases.

Having generally outlined the embodiments of this invention, the following example constitutes a specific illustration thereof. All amounts are as specified.

EXAMPLE

A vertically mounted stainless steel (type 316) tube which was 16 inches in length and 1.05 inch in internal diameter was charged with 70 grams of one-quarter inch quartz beads, followed by 102 grams of one-eighth inch pellets of a silica-on-alumina catalyst (Harshaw AL 1602T). This catalyst contained six percent silica and had a BET surface area of about 225 square meters per gram and a pore diameter of approximately 85Å. By-product polypropylene having a Brookfield viscosity of 1300 centipoises at 200° C., a number average molecular weight of 2700 and a weight average molecular weight of 4500 was heated to about 190° C. under an atmosphere of nitrogen, and the molten polymer was pumped into the bottom of the tubular reactor at a rate of 10 grams per minute.

The quartz bead section of the reactor served as the preheating section and was held at a temperature of about 470° C. The temperature in the catalyst section of the reactor was maintained at 450° C. The pressure was atmospheric. The product stream leaving the reactor first was cooled to about 170° C. and the product components which were liquid at this temperature were collected in a product drum provided with a water-cooled vent condenser for the condensation of additional components of the product stream which were relatively nonvolatile. The remaining volatile components of the product stream were passed through two traps cooled with dry ice to effect further condensation.

The total liquid product recovered from the product drum and the first dry ice trap was low in viscosity and amounted to 98.6% by weight of the by-product polypropylene fed to the reactor. The product was readily pumpable at 50° C. and remained fluid on storage at this temperature. Using gel permeation chromatography, it was determined that the liquid product had a number average molecular weight of 176 and a weight average molecular weight of 522. It had a specific gravity of 0.85 at 15° C. and a calorific value of 11,200 calories per gram. Repetition of this example using a catalyst temperature of 500° C. resulted in the formation of 6.4% gaseous products containing up to five carbon atoms. Moreover, following generally the procedure of this example, utilization of a chromic oxide-on-alumina catalyst at 500° C. led to the formation of 31% of $C_1$–$C_5$ gases.

The by-product polypropylene used in the process of this invention often is referred to as amorphous polypropylene. Actually, in addition to amorphous polymer, the by-product polypropylene may contain atactic, syndiotactic and stereoblock polypropylene, all of which are characterized by their solubility in boiling heptane. In contrast, the isotactic form of polypropylene is distinguished by its insolubility in boiling heptane. It is this difference in solubility in hot hydrocarbon solvents, as just illustrated in the case of heptane, which permits the isolation of isotactic polypropylene and the concurrent formation of a partially crystalline by-product containing other forms of polypropylene.

The cracking process in accordance with this invention utilizes a silica-on-alumina catalyst, which appears to be quite specific in obtaining the desired liquid fuel oil product in high yield with little formation of gaseous and volatile liquid products. Other alumina-based catalysts, for example, those containing metallic oxides such as chromic oxide and tungsten trioxide catalyze the formation of substantial amounts of volatile products. The preferred catalysts are those containing from about five to about 20 percent by weight of silica. The catalyst may be in powder, lump or pellet form and preferably has a BET surface area of from about 10 to about 400 square meters per gram, more preferably from about 25 to about 160 square meters per gram. Representative pore diameters of the catalyst are in the range of from about 35 to about 500 Å, preferably from about 80 to about 300 Å.

The catalyst should be periodically regenerated to remove the organic material and carbon which are deposited on its surface during continued use in the process of this invention. Regeneration is accomplished by passing a stream of an oxygen-containing gas over the catalyst at an elevated temperature, such as 600° to 650° C., thereby burning off the carbonaceous deposits.

In the process of this invention, the temperature of the catalyst is critical to the successful operation of the process. It has been found that, at temperatures below about 425° C., the by-product polypropylene is not converted at a practical rate to a product which is pumpable at 50° C. On the other hand, at temperatures above 475° C., the yield of the fuel oil product decreases substantially due to the formation of appreciable amounts of volatile products. The preferred temperature range is from about 440° to about 460° C.

Moreover, it is important that the by-product polypropylene be in contact with a sufficient amount of the catalyst during a given period of time in order that the desired conversion to a lower molecular weight, less viscous product will take place properly. If there is not enough catalyst for the amount of by-product polypropylene being fed to the reactor over a certain period of time, there will be insufficient catalysis to provide a fuel oil product having the viscosity necessary to permit it to be readily pumped and stored at the temperatures normally used for fuel oils. On the other hand, if the amount of catalyst per unit of polymer fed per unit of time is too great, the amount of volatile products increases and the yield of fuel oil decreases. Thus, space times in the range of from about five to about 15 grams of the catalyst per gram of the polymer fed to the reactor per minute have been found to be satisfactory. About 10 grams of catalyst per gram of polymer fed per minute is a preferable amount. It also is desirable in the process of this invention to effect prompt cooling of the product stream leaving the reactor to below 200° C. to hinder further cracking of the product.

What I claim and desire to protect by Letters Patent is:

1. A process for converting by-product polypropylene to a fuel oil product having the viscosity necessary to permit it to be readily pumped and stored at the temperatures normally used for fuel oils, said process comprising the steps of heating the by-product polypropylene to a temperature in the range of from about 150° to about 350° C. to provide a molten feed material and then contacting said feed material with a silica-on-alumina catalyst containing from about 5 to about 20 percent by weight of silica in a tubular reactor at a temperature in the range of from about 425° to about 475° C. and for space times in the range of from about five to about 15 grams of the catalyst per gram of said by-product polypropylene fed to the reactor per minute.

2. The process of claim 1 wherein the catalyst has a BET surface area of from about 10 to about 400 square meters per gram and a pore diameter of from about 35 to about 500 Å.

* * * * *